US006908075B1

(12) United States Patent
Nichols

(10) Patent No.: US 6,908,075 B1
(45) Date of Patent: Jun. 21, 2005

(54) SAFETY RAILING SYSTEM

(76) Inventor: Steve Nichols, 8522-216th St. SE., Woodinville, WA (US) 98072-8009

( * ) Notice: Subject to any disclaimer, the term of this patent is extended or adjusted under 35 U.S.C. 154(b) by 11 days.

(21) Appl. No.: 10/431,643

(22) Filed: May 6, 2003

Related U.S. Application Data

(60) Provisional application No. 60/378,296, filed on May 6, 2002.

(51) Int. Cl.[7] ..... E04G 5/04; E04G 3/08

(52) U.S. Cl. ..... 256/59; 256/DIG. 6; 182/113; 52/DIG. 12

(58) Field of Search ..... 256/59, 65.02, 256/65.03, 65.06, 65.07, 65.14, DIG. 6; 182/112, 182/113; 52/DIG. 12

(56) References Cited

U.S. PATENT DOCUMENTS 3,995,833 A * 12/1976 McLaughlin et al. ..... 256/59
4,666,131 A * 5/1987 Kettelkamp et al. ..... 256/59
4,669,577 A * 6/1987 Werner ..... 256/59 X
5,314,167 A * 5/1994 Holloman ..... 256/DIG. 6 X
5,573,227 A * 11/1996 Hemauer et al. ..... 256/65.06
5,638,917 A * 6/1997 Vennen ..... 182/113 X
5,829,549 A * 11/1998 Flynn
6,003,630 A * 12/1999 Whalen
6,015,028 A * 1/2000 Smith ..... 182/113 X
6,038,829 A * 3/2000 Franks ..... 256/65.14 X
6,053,281 A * 4/2000 Murray ..... 256/65.14 X
6,276,668 B1 * 8/2001 Sweeley ..... 256/59
6,666,298 B2 * 12/2003 Volkman
6,679,482 B2 * 1/2004 Allenbaugh ..... 256/65.14
2003/0015696 A1 * 1/2003 Warson ..... 256/65.14
2004/0007423 A1 * 1/2004 Scott ..... 182/113 X

* cited by examiner

*Primary Examiner*—Daniel P. Stodola
*Assistant Examiner*—Ryan M. Flandro
(74) *Attorney, Agent, or Firm*—Christensen O'Connor Johnson Kindness PLLC

(57) ABSTRACT

Upright stanchions with supports for removable horizontal safety rails have bottom end portions supported on base units that, in turn, are secured to wall framing from the inside of the framing.

2 Claims, 3 Drawing Sheets

SAFETY RAILING SYSTEM

CROSS-REFERENCE TO RELATED APPLICATION

This application claims the benefit of U.S. Provisional Application No. 60/378,296, filed May 6, 2002, which is expressly incorporated by reference herein.

FIELD OF THE INVENTION

The present invention relates to a system that provides one or more horizontally extending safety rails adjacent to a top plate in conventional framing construction, allowing workers to stand on the top plate adjacent to the rails, without unduly interfering with roof framing.

BACKGROUND OF THE INVENTION

During the framing phase of construction, exterior walls are built over a flat surface such as the first story floor or concrete slab, then raised and braced in the upright position. Exterior wall sheathing may be applied before or after raising the wall. Similarly, completely or partially prefabricated walls may be set and braced in the upright position, prior to framing of the roof. Roof framing can be by trusses or "stick framing" which includes setting the rafters. Typically workers perform much of the roof framing work (fastening the trusses/rafters to the top plates of the wall and installation of blocking between the trusses/ rafters) while standing on the top plate. This exposes the worker to a fall hazard to both the inside and outside of the wall.

Roof-mounted lifeline fall protection systems do not provide adequate structural strength until after the roof understructure has been cross-braced and sheathed. Other possible fall protection systems, such as masonry scaffold or exterior wall-supported scaffold, can be costly and time consuming to set up.

SUMMARY OF THE INVENTION

The present invention provides a fall protection system usable during roof framing. The system provides one or more safety railings above and to the outside of the top plate. In one aspect of the invention, upright stanchions with supports for removable rails have bottom end portions supported on brackets that, in turn, are secured to the wall framing. The brackets can be easily installed on the wall framing by fasteners that attach the brackets to the wall studs from the inside of the wall.

BRIEF DESCRIPTION OF THE DRAWINGS

The foregoing and other aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
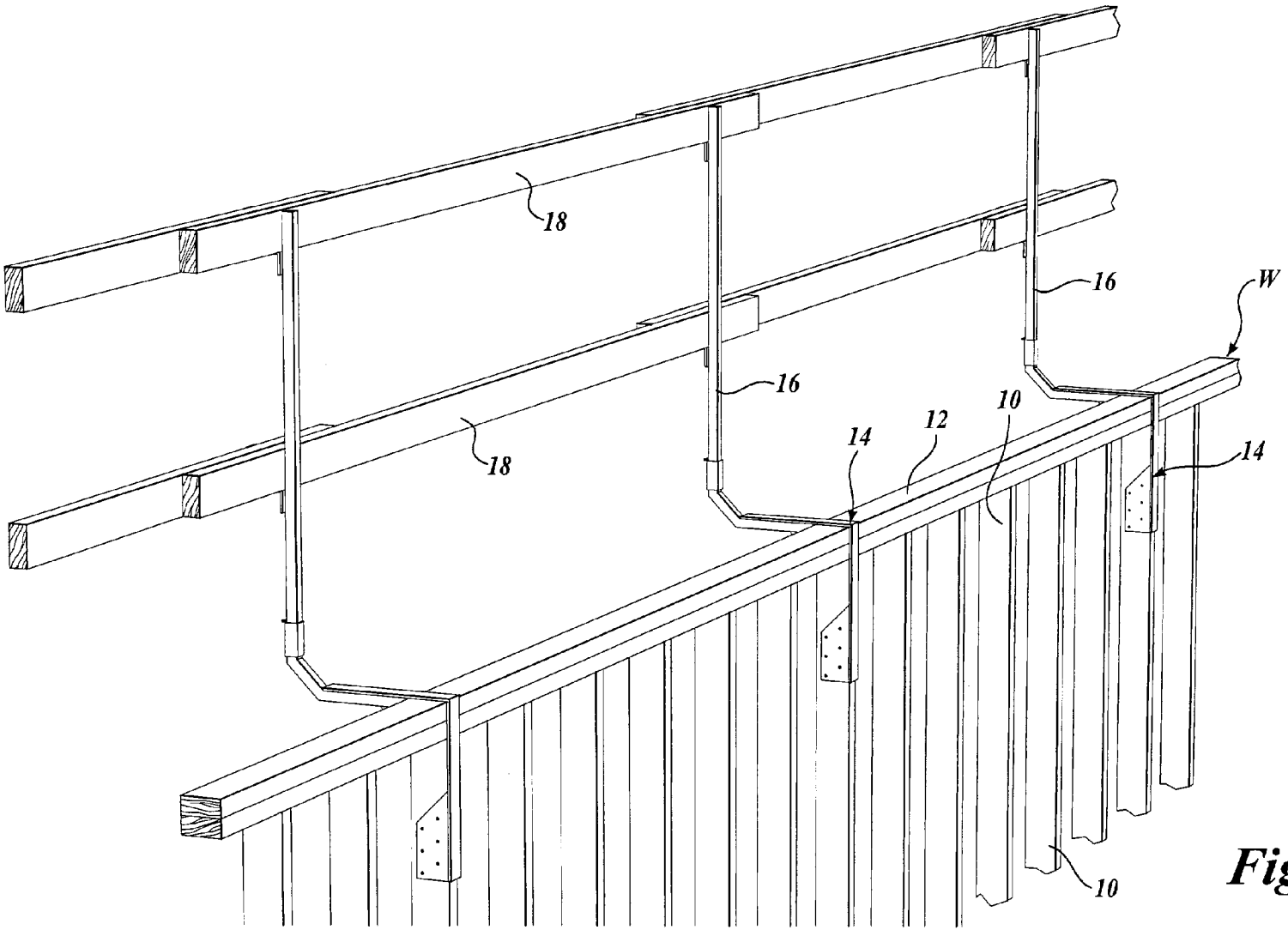
FIG. 1 is a diagrammatic top perspective of a safety railing system in accordance with the present invention.

With reference to FIG. 1, a framed and raised wall W has uniformly, laterally spaced upright studs 10 and a horizontal top plate 12 (in this case, a double top plate) supported on the upper ends of the studs. The safety railing system of the present invention is supported from the studs and top plate. As described in more detail below with reference to FIG. 2 and FIG. 3, the components of the present invention include: bottom brackets 14 secured to the studs at the inside of the wall; upright stanchions 16 supported on the brackets 14; and horizontal rails 18 supported on the stanchions 16.

Figure 2:
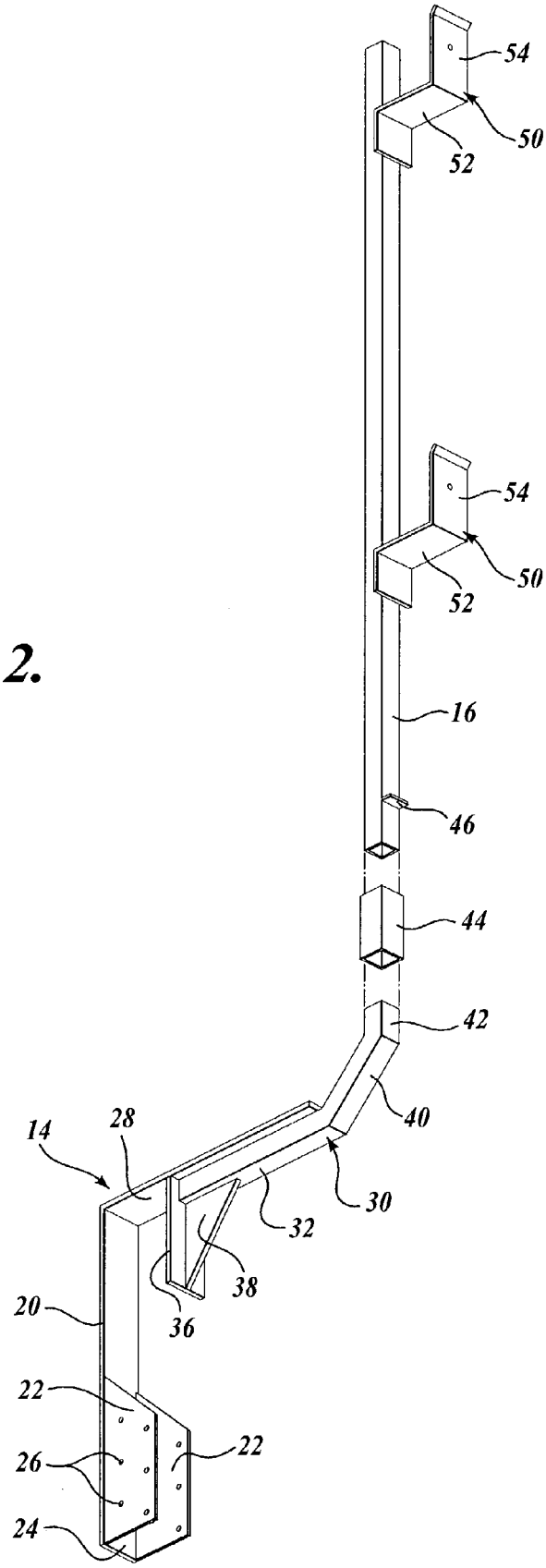
FIG. 2 is an enlarged top perspective of components of the safety railing system of FIG. 1, with some parts shown in exploded relationship.
Figure 3:
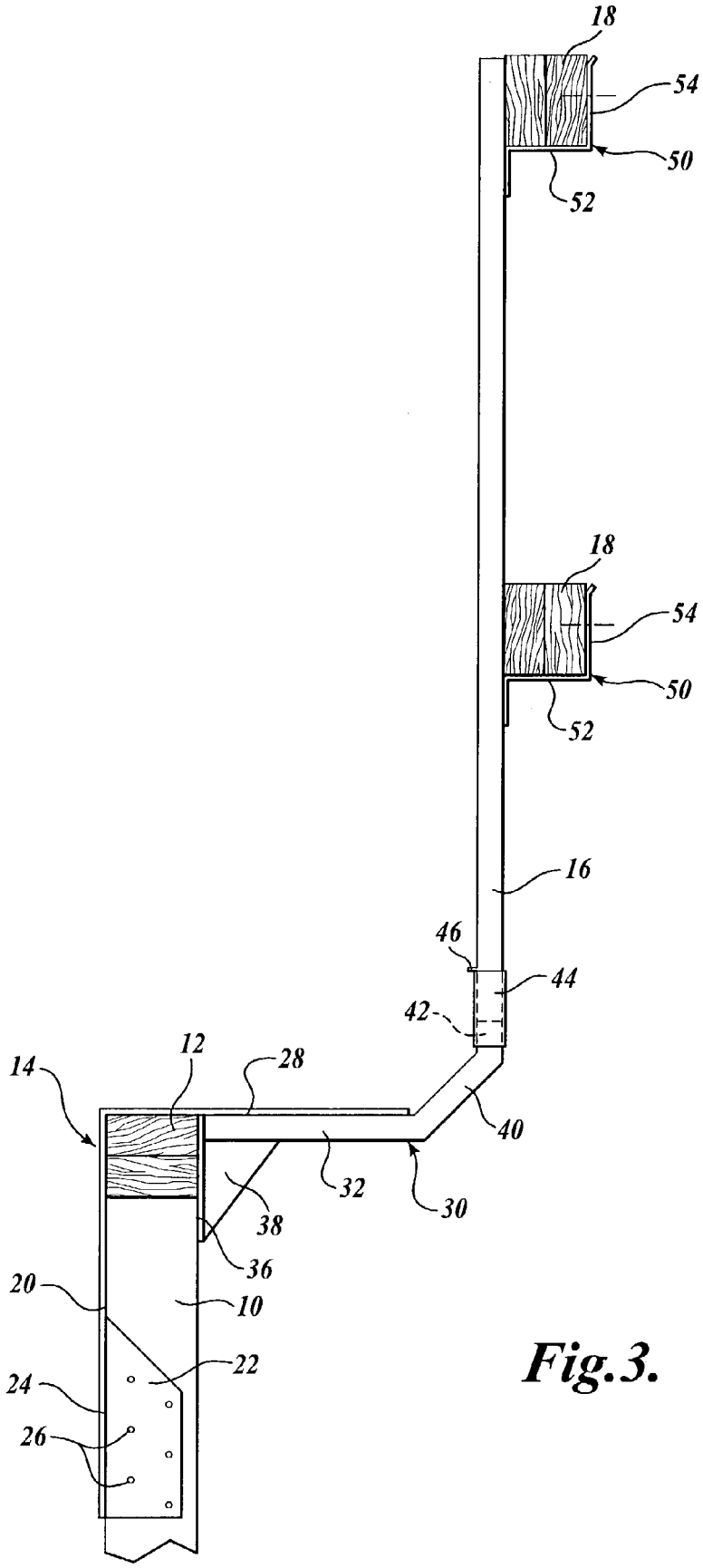
FIG. 3 is a side elevation of components of the safety railing system in accordance with the present invention, with the parts assembled.

With reference to FIGS. 2 and 3, each of the brackets 14 has a U-shaped lower or base portion 20 with opposite upright sides 22 and an inside web 24 connecting the sides. The sides 22 and web 24 embrace the opposite sides and the inside face of a single stud 10 near its top. The bracket 14 is secured to the stud, such as by 16*d* nails. For this purpose, the sides 22 can be provided with holes 26. Double-headed nails can be used so that the bracket 14 is more easily removable following completion of any part of the construction which requires that a worker stand on the top plate 12.

The web 24 extends upward to a horizontal plate 28. Plate 28 fits flush on the top plate 12 and extends horizontally outward therefrom. A support member 30 has a horizontal portion 32 secured beneath the outward extending plate 28. The inner end of the support member horizontal portion 32 preferably is spaced outward from the exterior side of the stud 10. An outside upright plate 36 extends downward from the horizontal plate 28, close alongside the outer face of the stud 10. A triangular gusset 38 reinforces the connection of the outside plate 36 with the horizontal segment 32 of the support 30.

From its horizontal segment 32, the support 30 has an angled segment 40 leading to a short upright segment or stub 42. The upright stub is secured to or fits within a sleeve 44 which forms an upward opening socket for the lower portion of a stanchion 16 of the railing system. The bottom end of the stanchion fits within the socket in a snug, sliding fit, and the stanchion extends essentially vertically upward therefrom. A short stop flange 46 can be provided on the lower end of the stanchion to limit its insertion into the sleeve 44. The stanchion carries angle brackets or supports 50 including bottom sections 52 and outside upright sections 54. The preferred support 50 is mounted on the outside of the stanchion as shown at the right of FIG. 3, but inside brackets and rails could be provided instead. Long rails 18 fit in the supports 50. The width of each support 50 is sufficient to receive overlapping end portions where one rail end fits alongside an end portion of another rail. In an alternative embodiment, the brackets can be of sufficient depth (vertically) to receive both end portions, one on top of the other, rather than side by side.

The composite supports of the railing system can be spaced along a wall during framing, either before or after the wall has been raised, and either before or after installation of the wall sheathing. The supports can be spaced approximately 8 feet apart. In a representative embodiment, the horizontal railings were standard 2×4 stock; the brackets 14, plates 28 and 36 and gusset 38 all were 3/16 inch mild steel plate; the support bar 30 and stanchions 16 were solid 1 inch mild steel square tube; the sleeves 44 were 1/8 inch square tube; and the brackets 50 were 1/4 inch mild steel plate. The parts were secured together by welding.

The base component can be manufactured in several sizes to accommodate any top plate dimension. Consequently, the stanchions can be used with multiple base components. The telescoping connection of the stanchions to the base components allows easy set up, reduced bulk in shipping, and replacement of damaged components without scrapping an entire composite unit. Attachment of the base component or bracket 14 to a stud, in combination with the outside upright plate 36 and gusset 38 provides substantial rigidity and assists in transferring force applied to the rails and stanchions to the top plate and wall stud. The use of two angle bends, i.e., the angled segment 40 between the horizontal support 32 and vertical stub 42, has a shock absorbing capability that reduces stress and allows the component to deflect when a force is applied to the guard rail, thus reducing structural damage or rail failure.

The system of the present invention will not substantially interfere with installation of exterior wall sheathing, siding, etc. All components can be conveniently removed when the railing is no longer needed, usually after roof trusses have been installed. If necessary, one or more sections of stanchions and railings can be detached to allow entrance or movement of framing materials, followed by quick and easy deployment of those sections for safety.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A safety railing system comprising a framed wall section having an inside and an outside, the wall section including laterally spaced upright studs and a horizontal top plate supported on upper ends of the studs, the railing system including brackets having base portions mounted on the studs from the inside of the wall section and spaced along the top plate, upright stanchions connected to and supported on the base portions, and one or more horizontally elongated safety rails supported on the stanchions, each base portion including a U-shaped section having opposite upright sides and a web, the U-shaped section embracing opposite sides and an inside face of a stud at the inside of the wall section, such base portion being adapted for securing to the stud by mechanical fasteners.

2. The safety railing system defined in claim 1, in which the base portion includes a horizontal section extending flush over the top plate and an outside upright plate extending downward from the horizontal section close alongside the outside of the wall section.

* * * * *